United States Patent [19]

Wilcox

[11] Patent Number: 4,929,112

[45] Date of Patent: May 29, 1990

[54] TOOL HANDLE WITH PIVOTING HEAD

[76] Inventor: Robert Wilcox, P.O. Box 1401, Hanford, Calif. 93232-1401

[21] Appl. No.: 782,027

[22] Filed: Sep. 30, 1985

[51] Int. Cl.[5] ..... B25G 1/06; B25G 3/38

[52] U.S. Cl. ..... 403/93; 15/144 A; 294/19.1; 294/53.5

[58] Field of Search ..... 294/19.1, 1.1, 22, 23, 294/51, 53.5; 15/144 R, 146, 144 B, 144 A; 81/177.7, 177.75, 177.8; 403/93

[56] References Cited

U.S. PATENT DOCUMENTS

| | | | |
|---|---|---|---|
| Re. 12,769 | 3/1908 | Palmer . | |
| 2,794,265 | 6/1957 | Kruger . | |
| 3,778,860 | 12/1973 | Thielen | 15/144 A |
| 4,127,296 | 11/1978 | Thomson | 294/19.1 |
| 4,353,142 | 10/1982 | Nishiyama et al. | 15/144 R |

*Primary Examiner*—Johnny D. Cherry
*Attorney, Agent, or Firm*—Michael J. Tavella

[57] ABSTRACT

A new tool handle is disclosed that permits a wiping blade, brush, or similar tool to be positioned in a variety of angular positions. The device utilizes a spline, set in a block to rotate the tool carrying wrist. The spline is locked into place by a pin which is slidably positioned within the block. The handle of the device is used to engage the pin. The handle is provided with threads which engage similar threads in the block. As the handle is screwed into the block, it engages the pin and pushes it upwards against the spline, thereby locking the tool carrying wrist in place. The angle can be changed by simply backing out the handle until the pin drops, thereby releasing the spline, which can then be rotated into a new position and again locked into place. The device also utilizes a blade mounting plate which attaches to the tool carrying wrist. The working tools are attached to this plate. The plate is fastened to the wrist by a bolt, nut and nylon washer. The washer allows the blade mounting plate to rotate without losing tension on the bolt. This arrangement prevents the plate from working loose when the blade is being turned.

5 Claims, 2 Drawing Sheets

TOOL HANDLE WITH PIVOTING HEAD

BACKGROUND OF THE INVENTION

This invention is related to tool handles, and more particularly to tool handles that can pivot is two directions.

BRIEF DESCRIPTION OF THE INVENTION

The present invention relates to wiping tools of the type normally used in finishing, painting and texturing plaster and wallboard, and the like. Typically, these tools consists of a blade, brush or roller, and a handle. The handle is typically provided with a threaded portion on the lower end so that extensions can be added to enable a longer reach. One problem frequently encountered with these tools is their inability to bend or pivot around corners or reach areas of excessively high ceilings. These more difficult areas require the workers to substitute scaffolding, ladders and other means to reach these areas. This of course adds time and expense to the job.

The present invention solves these problems by allowing the blade, or other attachment, to pivot on two different axes simultaneously (i.e. front-to-back and side-to-side); the tool can also be extended to reach any heights needed with extension poles. This allows the craftsman to continue wiping or painting, etc., no matter what direction the surface lies, as it is a simple matter to adjust the setting of the tool. The tool consists of a handle adapter that is fitted on one end with a threaded insert that mates with a wrist block. The wrist block is a block of aluminum or like metal. The wrist block is drilled and tapped to accommodate the threaded portion of the handle. The wrist block is also provided with an inner cavity in which a plunger pin is placed. The plunger pin is designed to be moved when the threaded handle insert is screwed in place. The wrist block is also provided with a spline pin, which is placed perpendicularly within the block with respect to the plunger pin, such that as the threaded portion of the handle engages the plunger pin, the plunger pin is forced against the spline pin. The plunger pin is also provided with a serrated face, which is designed to contact the spline pin and prevent it from rotating.

An aluminum wrist is provided which is secured to the wrist block by a nut and bolt. The bolt passes through the center of the spline pin. This arrangement allows the wrist to rotate around the wrist block, with the spline pin rotating with the wrist. Once the proper angle has been selected for the wrist, the handle is tightened against the wrist block until the plunger pin is forced against the spline and the plunger pin teeth lock the spline into place. Once locked, the tool will maintain the chosen angle until the handle is backed off, and the plunger pin drops, thereby releasing the spline pin.

The wrist has an extended vertical portion, to which the blade mount plate is attached. The blade mount plate is a triangular metal plate in which mounting holes have been drilled. This plate is used to attach the wiping blade or other tool as may be desired. The blade plate is attached with a bolt and nut. A nylon washer is also provided which acts as a bearing to allow the blate plate, and thus the blade, to rotate around the bolt. This rotation is perpendicular to that of the wrist (side-to-side vs. front-to-back). The rotation of the blade plate is independent to that of the wrist, thereby providing a wide range of angles and placements that the tool can be set.

DETAILED DESCRIPTION OF THE PREFERRED EMBODIMENT

Figure 1:
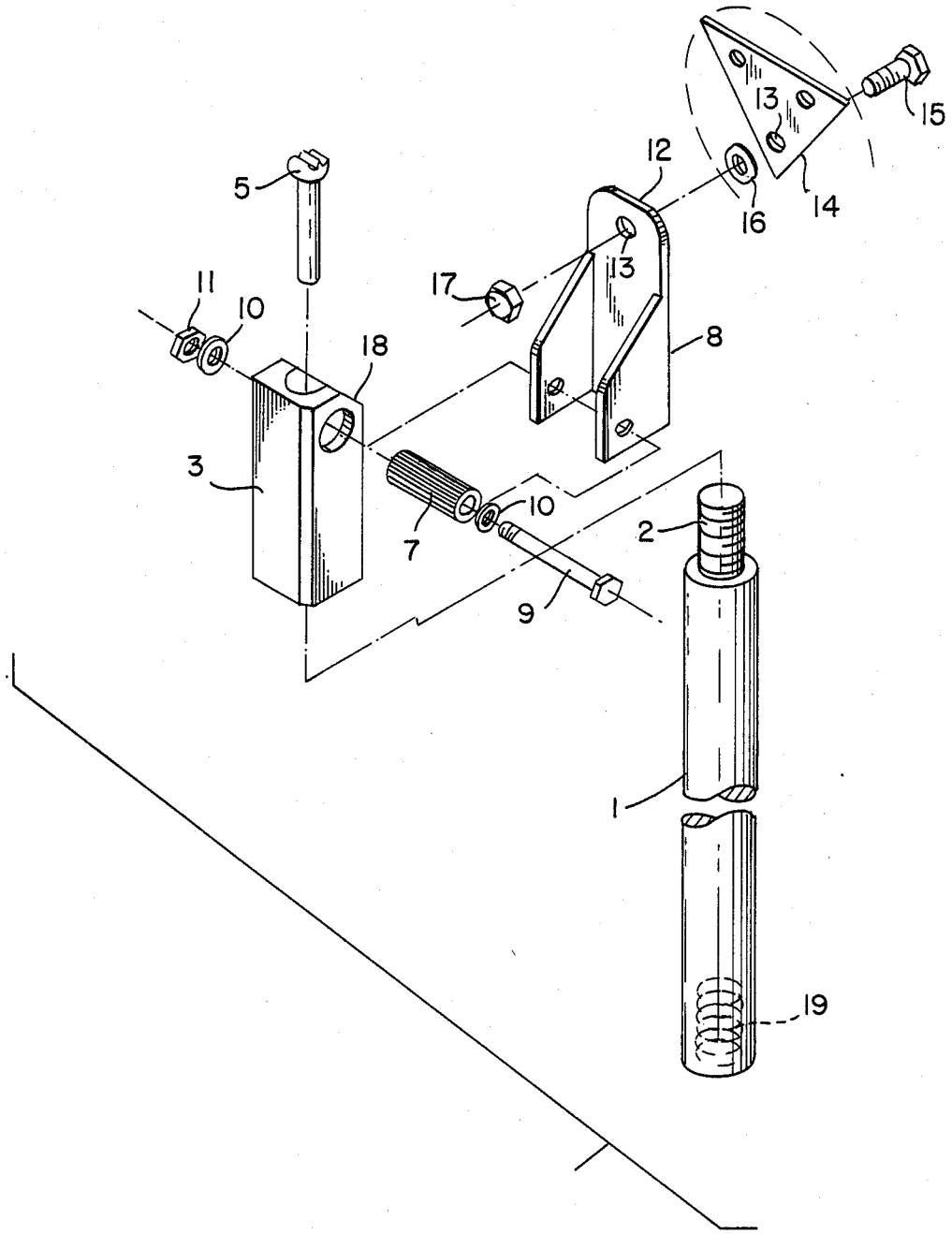
FIG. 1 is an exploded view of the tool, showing all of its parts.

Referring now to the drawings, and in particular, FIG. No. 1, the invention consists of a handle 1 which has a male threaded portion 2 extending upwardly therefrom. The male threaded portion 2 has thread count of 10 per inch in the preferred embodiment. This thread spacing ensures proper tension on the control parts, discussed below.

The invention also utilizes a wrist block 3. The wrist block 3 is provided with a female threaded portion 4 (see FIGS. 2 and 3), which is designed to match the threaded male portion 2 of the handle. A plunger pin 5 is installed within the wrist block 3 as shown. The plunger pin is designed to fit within the wrist block in the space shown. A shoulder 6 is provided in the wrist block which supports the plunger pin 5 in its fully retracted position. The shoulder 6 also prevents the plunger pin 5 from falling through the bottom of the wrist block 3, when the handle 1 is removed. A spline 7 is also placed within the wrist block as shown. The spline 7 is standard 16 tooth spline stock. The spline 7 is designed to rotate within the wrist block 3.

A wrist 8 is attached to the wrist block 3 by means of a bolt 9, two washers 10 and a nut 11. The bolt passes through the ears of the wrist and through the spline 7. The wrist 8 is designed to rotate with the spline 7, and the spline 7 is held in place within the wrist block 3 by the wrist 8, which covers the spline 7 as it is positioned around the wrist block 3. The wrist 8 is secured to the wrist block 3 by a bolt and nut which pass through the wrist 8, the wrist block 3, the spline 7, the wrist block 3 again, and finally, through the other ear of the wrist 8.

The wrist 8 has an elongated portion 12, which is provided with a hole 13. A tool or blade mounting plate 14 is bolted to the wrist 8 at hole 13. In the preferred embodiment, the blade mounting plate 14 is secured to the wrist 8 with a bolt 15, a nylon bushing washer 16 and a nut 17. This arrangement allows the blade mounting plate 14 to be rotated around the wrist 8 as illustrated by the dotted line in FIG. 1. The tension of the bolt 15 and the nut 17 will determine how well the blade mounting plate 14 will be locked into place. The nylon washer 16 allows the blade mounting plate to turn when there is tension on the bolt and nut.

The blade mounting plate is provided with two holes at the top portion of the plate which are used to fasten a wiping blade (not shown), or any other wiping, brushing or cutting tool that is desired. It is possible to design a mounting adapter bracket that would allow many other tools to be attached to the adapter and then to the device. Tools such as wrenches and screwdrivers can be attached to the device and positioned in a wide variety of working angles.

Figure 2:
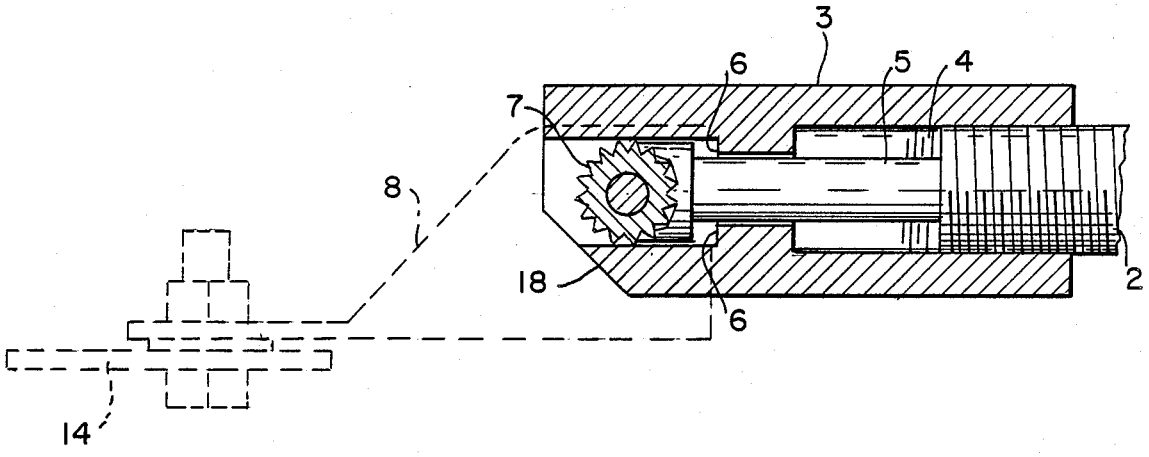
FIG. 2 is a detail of the wrist block showing the plunger pin in its locked position.
Figure 3:
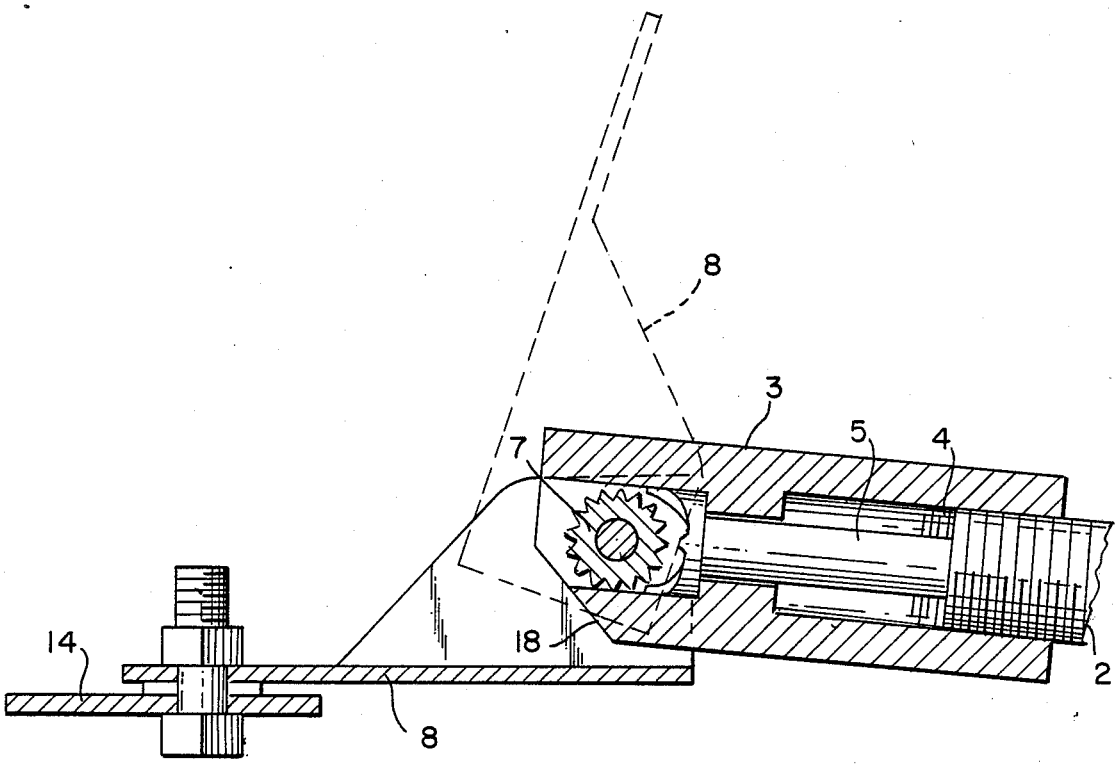
FIG. 3 is a detail of the wrist block with the wrist pin retracted; it also shows the full extent of travel that the wrist is able to travel.

Referring now to FIG. 3, the wrist 8 is capable of being rotated around the wrist block 3 to the extent illustrated in the drawing. A beveled portion 18 is provided on the edge of the wrist block 3 to allow for full rotation of the wrist. As shown, when the wrist 8 is being rotated, the plunger pin 5 is retracted. It is important to design the depth of the cavity, however, to prevent the plunger pin 5 from retracting too far. In the preferred embodiment, the outer ears of the pin 5 should be higher than the center tooth of the pin 5 (see FIGS. 2 and 3). This prevents the pin 5 from rotating when retracted, such that if the spline 7 was removed from the wrist 8 and the pin 5 was rotated 90 degrees, the spline 7 could not be fully inserted into the wrist 8 as it would be in contact with the outer ears of pin 5.

Referring now to FIG. 2, once the desired angle is chosen for the wrist 8, the wrist is locked into place by the pin 5. The handle 1 is tightened down into the wrist block 3 which pushes the plunger pin 5 tightly against the spline 7 engaging the tooth and locking the spline-wrist combination in place. In the preferred embodiment, 10 threads per inch was used for the threaded portion 2 of the handle 1 and that of the wrist block. This thread spacing allows proper tension to be developed which prevents the turning of the spline 7 within the wrist block. If a different thread dimension is used, a spring (not shown) may be necessary to ensure proper tension.

The handle 1 is also provided with a female threaded portion 19 which is fitted into the opposite end of the handle from the male threaded portion. This female portion is used to attach extension handles to the handle of the tool, thereby extending its useful range.

The device is primarily made of aluminum. The handle, wrist block, wrist, and blade mounting plate are all fashioned from aluminum 2024 stock. This material was chosen for its strength and its light weight. In mass production, cast aluminum can be used for the wrist block as well.

The threaded inserts in the handle are also aluminum plugs (2024). These plugs are press fit into the tubing stock used for the handle. In the preferred embodiment, the male threaded portion 2 is $\frac{3}{4}'' \times 10$ acme threads, while the female threaded portion 19 is 5 acme tooth 4 face interval threads.

The device is used by backing the handle 1 out from the wrist block 3 until the plunger pin 5 has dropped down, thereby releasing the spline 7. Once the spline 7 is free to rotate, the entire wrist/blade assembly can be rotated to the desired angle and held. The handle 1 can then be retightened into the wrist block 3 until the plunger pin 5 is again in firm contact with the spline 7, thereby locking the spline 7 and, therefore, the wrist/-blade assembly, into place. Whenever it is desired to adjust the lateral angle of the blade, regardless of the angle of the wrist, the blade is turned, thereby turning the blade mounting plate to the desired angle. It is not necessary to loosen the mounting bolt and nut in order to allow the blade mounting plate to turn. The nylon bushing allows enough slippage, without losing needed tension to hold the blade.

I claim:

1. A tool holder having an attachment for interchangeable tools comprising:

A. a handle;

B. first angular control means, threadably attached to said handle, such that said first angular control means can be removed from said handle;

C. locking means disposed within said first angular control means and activated by said handle when said handle is attached thereto;

D. a wrist portion rotatably attached to, and angularly controlled by, said first angular control means such that said wrist portion can be positioned at a chosen operating angle and locked in place by said locking means;

E. an attachment plate rotatably fastened to said wrist portion;

F. second angular control means attached to said wrist portion such that said attachment plate can be rotated to a selected angle and locked into position.

2. A tool holder having attachment means for interchangeable tools comprising:

A. a handle having two ends;

B. a threaded insert portion fixedly attached to one end of said handle, forming a male threaded portion;

C. a wrist block portion, having a threaded insert portion at one end, said threaded insert portion forming a female threaded portion, said block portion also having an internal cavity;

D. a plunger pin slidably disposed within the internal cavity of said wrist block portion such that one end of said plunger pin extends into the threaded portion of said wrist block portion so that said male threaded portion of said handle contacts the plunger pin when the threads are engaged and the plunger pin is pushed upwardly within said cavity as the threads are advanced;

E. tooth means fixedly attached to the other end of said plunger pin;

F. spline means rotatably disposed within said wrist block portion and perpendicularly positioned with respect to the tooth means of the plunger pin such that said tooth means engage spline members on the spline means and lock said spline means in a fixed position when said plunger pin is pushed upwardly by the engagement of the threaded portion of the handle, and said spline means being released from said fixed position when said threaded portion is reversed and removed, thereby allowing the plunger pin to drop downwardly away from said spline means;

G. wrist means fixedly attached to said spline means such that said wrist means rotates around said wrist block portion when said plunger pin is released, and is fixed at an angular position when the plunger pin engages and locks the spline means;

H. tool attachment means rotatably attached to said wrist means;

I. bushing means fixedly attached to said wrist means such that the tool attachment means can be set in an angular position with respect to the wrist means;

J. locking means, fixedly attached to said wrist means to secure said tool attachment means in the chosen angular position.

3. The tool holder as claimed in claim 2 further comprising:

a female threaded portion, fixedly attached to the other end of said handle.

4. The tool holder as claimed in claim 2 wherein the bushing means comprise a nylon washer.

5. The tool holder as claimed in claim 2 wherein said tool attachment means comprises a triangular plate having three equally spaced mounting holes therein.

* * * * *